US006102325A

United States Patent [19]

Kohnen

[11] Patent Number: 6,102,325

[45] Date of Patent: Aug. 15, 2000

[54] REEL SLITTING DEVICE AND GUIDE DEVICE

[75] Inventor: Josef Kohnen, Tönisvorst, Germany

[73] Assignee: Voith Sulzer Finishing GmbH, Krefeld, Germany

[21] Appl. No.: 09/102,284

[22] Filed: Jun. 22, 1998

[30] Foreign Application Priority Data

Jun. 27, 1997 [DE] Germany ..... 197 27 326

[51] Int. Cl.[7] ..... B65H 18/08; B65H 23/24; G03B 1/52

[52] U.S. Cl. ..... 242/530.4; 242/417.1; 242/525.7; 242/615.11

[58] Field of Search ..... 242/530.4, 530, 242/525, 525.6, 525.7, 417.1, 615.11

[56] References Cited

U.S. PATENT DOCUMENTS

| | | |
|---|---|---|
| 3,808,771 | 5/1974 | Drella et al. . |
| 3,847,319 | 11/1974 | Brandon et al. . |
| 4,147,287 | 4/1979 | Reba . |
| 4,785,985 | 11/1988 | Hurtgen . |
| 5,014,447 | 5/1991 | Hagen . |
| 5,152,471 | 10/1992 | Goerner . |
| 5,308,006 | 5/1994 | Hehner . |
| 5,782,425 | 7/1998 | Leskinen et al. . |

FOREIGN PATENT DOCUMENTS

| | | |
|---|---|---|
| 355413 | 3/1980 | Austria . |
| 0315569 | 5/1988 | European Pat. Off. . |
| 2322822 | 11/1974 | Germany . |
| 3607136 | 11/1986 | Germany . |
| 3737504 | 5/1989 | Germany . |
| 2097766 | 11/1982 | United Kingdom . |

*Primary Examiner*—Donald P. Walsh
*Assistant Examiner*—William A. Rivera
*Attorney, Agent, or Firm*—Greenblum & Bernstein, P.L.C.

[57] ABSTRACT

Reel slitting device for a material web that includes a slitting station that slits the material web into a plurality of partial webs and a winding station that winds the plurality of partial webs into a plurality of partial web rolls. The winding station includes at least two winding position groups having winding units, such that winding units within a same winding position group are located at a distance from each other to form gaps between adjacent partial webs within the same winding position group. The reel slitting device also includes a guide device that guides the partial webs between the slitting station and the winding position groups, the guide device being divided into a plurality of zones that are arranged transversely to a run direction of the partial webs and that are individually activatable.

21 Claims, 1 Drawing Sheet

REEL SLITTING DEVICE AND GUIDE DEVICE

CROSS-REFERENCE TO RELATED APPLICATIONS

The present application claims priority under 35 U.S.C. § 119 of German Patent Application No. 197 27 326.2, filed on Jun. 27, 1997, the disclosure of which is expressly incorporated by reference herein in its entirety.

BACKGROUND OF THE INVENTION

1. Field of the Invention

The present invention relates to a reel slitting device for a material web. The reel slitting device includes a slitting station for slitting the material web into partial webs and a winding station to wind the partial webs into partial web rolls. The winding station includes at least two winding position groups having winding units located at a distance from each other and with a gap between adjacent partial web rolls in a same winding position group. The winding station also includes a guide device for guiding the partial webs between the slitting station and the winding position groups.

2. Discussion of Background Information

Paper webs are often produced in widths that are larger than those required by a subsequent processor or user, i.e., modern paper machines produce paper webs having working widths of up to 10 m. However, printers and other subsequent processors (consumers) of the paper webs generally require more manageable paper web widths in a range of 0.4 to 3.8 m.

For this reason, paper webs are slit into desired widths in one of the last production steps. In this manner, partial webs are formed, and each partial web is separately rolled into a partial web roll. In winding the partial web rolls, it has proven advantageous to divide the winding units into at least two groups so that the partial web rolls in each group are arranged essentially coaxially. Further, the partial web rolls in both groups are staggered opposite each other to form a gap between individual partial web rolls in a same group. In this manner, holding elements may be located within the gaps. Because the partial web rolls are wound in winding positions that are arranged in groups, these arrangements are generally referred to as "winding position groups".

In order to supply the partial webs to corresponding partial web rolls in the winding position groups, a guide device is necessary. In particular, at the beginning of the winding process, the guide device must ensure that partial webs are supplied or guided to the "correct" winding position. Such guide devices are known in the art for guiding adjacent partial webs in varying or different directions.

In many cases, a reel slitting device is to be provided to produce partial webs having varying or different widths. To provide the necessary slitting of the web, the reel slitting device includes a slitting station having displaceable knives that are located at positions along the width of the web that correspond to the desired widths of the partial web rolls. Further, in the winding station, the winding units must be appropriately oriented in the width direction, so that the partial webs can be wound with as little expenditure as possible. Likewise, the guide device must be arranged to guide the appropriate widths of the partial webs to the winding device. Thus, the guide device must be adapted to the various widths of the partial webs to be produced. However, adapting the guide device for the various widths of the partial webs is more difficult than adjusting the slitting device or the winding device, because the guide device operates over the entire width of the partial web. Thus, in addition to being adjustable to change position, the guide device must have a working width that is adjustable to accommodate the width of the partial web to be guided. Thus, changing a roll cycle, i.e., changing the widths of the partial web rolls, generally requires a considerable expenditure. However, such changes are necessary in order to provide flexibility in production to meet the demands of consumers that require specific roll widths.

SUMMARY OF THE INVENTION

The present invention provides a device that facilitates changing the roll cycle.

The present invention provides a reel slitting device of the type generally discussed above that includes a guide device that is dividable into a plurality of zones that extend transversely to a run direction of the partial webs. Each of the plurality of zones are individually activatable.

In accordance with an exemplary embodiment of the present invention, it is not necessary to mechanically alter the width of the guide device, i.e., to displace guide elements transverse to the run direction or to alter their working widths. Rather, the guide device of the present invention can operate over an entire width of the (unslit) material web, i.e., over the width of a jumbo or mother roll. Adjustment of the guide device to accommodate various individual widths of the partial webs occurs because the guide device is activated only in the areas associated with the widths of the partial webs to be guided, i.e., where the individual partial web are guided over the guide device. For this, the guide device is divided into a plurality of individually activatable zones that are particularly narrow in width. Thus, to guide a partial web in a corresponding direction, the zones of the guide device that correspond with the position of the partial web are activated. If the width and/or the position of this partial web changes, then the necessary zones corresponding to the new width are activated and the zones not associated with the new width are not activated. In this manner, the partial web may be guided without requiring mechanical modification of the guide device.

In an exemplary embodiment, a guide device is provided in separate paths for each winding position group, and the activated individual zones in the guide device in one path are substantially complementary to the activated individual zones in the other path. This is particularly useful when, as discussed at the outset, adjacent partial webs are deflected in different directions to opposite winding position groups, i.e., guided along different paths. In accordance with the exemplary embodiment, the two paths cannot simultaneously affect the partial web, which makes controlling the guiding of the partial webs easier. Further, misrouting individual partial webs will generally not arise due to operator errors. Therefore, if a zone group is active in a given guide device to guide the partial web along a given path, i.e., to a particular winding position group, then the corresponding zone group in the other guide device of the other path is not active, i.e., guiding the web along this other path is excluded.

The guide device may advantageously include a pneumatically-functioning switch point following the slitting station. The "fanning" of the partial webs, i.e., the guiding of adjacent partial webs in different directions, is controlled via the switch point. The pneumatic operating characteristic permits simple controlling because, with the aid of valves, air currents can be turned on and off very easily.

In this regard, it is especially advantageous that the switch point includes two blowpipes having jets that are oriented in directions opposite each other. Thus, if one jet is activated, then the partial web is deflected in one direction; if the opposing jet is activated, then the partial web is deflected in the other direction. Because simultaneous activation of the jet in both directions is excluded by the substantially complementary zone activation, a safe and dependable control for guiding the individual partial webs is produced.

The guide device may advantageously includes cooling baffles. The cooling baffles guide the partial webs on "air cushions", so that they may be carried, at least in part, without contact with the guide device. This is particularly well suited for web sections running in a straight line, and contributes to careful treatment of the partial webs. Even the cooling baffles can be individually controlled from zone to zone, which reduces the use of air. Of course, this does not exclude guiding the partial webs over deflection rolls upon which they lie. However, the cooling baffles make the automatic guiding easier between the individual deflection rolls, and manual threading of the partial webs, which is very difficult due to the customarily greater number of partial webs formed, can be eliminated.

It may be advantageous that at least parts of the cooling baffle may be swivelled. This is particularly favorable if the web progression changes during the course of the winding process. A configuration of this type occurs, e.g., if the winding core of the partial web rolls remains substantially stationary and the increasing diameter of the partial web rolls changes a point of contact of the partial web onto the partial web roll.

The width of the zones may be advantageously smaller that a width of the most narrow partial web roll to be processed. As a rule, it is generally known from the beginning of the process the widths of the partial web to be processed by the reel slitter. Thus, by adjusting the width of the zones in accordance with the smallest width of the partial webs to be processed, it can be ensured that all partial webs can be processed in accordance with the present invention.

Because the most narrow partial webs processed generally have a width of approximately 400 mm, it may be preferable to form the zones with widths between, e.g., approximately 200 mm and 300 mm. In this manner, processing of all partial webs is ensured.

It may be advantageous to only partially activate zones of the guide device in which the edges of the partial web run. That is, while there are sections along the web progression in which activation of the guide device is favorable or desirable, in other sections, e.g., in the switch points, activation may be detrimental. In the switch point, it is only necessary that the partial webs be diverted in different directions. Thus, guiding can be performed by only activating the zones in the middle of the partial web, i.e., not at the edges. Further, edges of adjacent partial webs, i.e., where the material web was slit, may be in a same zone in the different guide devices to form overlapping zones. Thus, via the complementary zone activation arrangement, only one of the edges would be properly guided, while the edge in the same zone in the other guide device may be detrimentally affected. Thus, overlapping zones may be deactivated entirely, i.e., "switched off" for both paths. However, with regard to the cooling baffles, overlapping zones are not detrimental to processing of the partial webs even when the zone that projects over the side edge of the partial web is still activated. At most, air losses may occur due to overlapping zones in the cooling baffles, which is acceptable because the partial web is being supported along its entire width.

In a preferred embodiment, the slitting station includes slitting devices with knives that are adjustably positionable transversely to the run direction of the material web via a control device. The control device may also be coupled to the guide device to control the individual zones of the guide device in accordance with the particular positioning of the slitting devices. In this case, only a single control device is necessary. Aside from simplifying the industrial construction, this arrangement also results in a simplification of operation. For example, the slitting cycle, i.e., the width of individual partial web rolls, must only be entered once. Thereafter, the control device positions the knives of the slitting device and simultaneously establishes the zones of the guide devices that are to be active, inactive, and partially active.

Accordingly, the present invention is directed to a reel slitting device for a material web that includes a slitting station that slits the material web into a plurality of partial webs and a winding station that winds the plurality of partial webs into a plurality of partial web rolls. The winding station includes at least two winding position groups having winding units, such that winding units within a same winding position group are located at a distance from each other to form gaps between adjacent partial webs within the same winding position group. The reel slitting device also includes a guide device that guides the partial webs between the slitting station and the winding position groups, the guide device being divided into a plurality of zones that are arranged transversely to a run direction of the partial webs and that are individually activatable.

In accordance with another feature of the present invention, the guide device, extending over a width of the material web, may form separate paths to each winding position group, and individual zones in one of the separate paths may be substantially complementarily activated with respect to corresponding individual zones in the other of the separate paths that are not activated.

In accordance with another feature of the present invention, the guide device includes a pneumatically-functioning switch point positioned downstream of the slitting station in the run direction. Further, the switch point includes two blowpipes producing air jets. The air jets of one of the blowpipes are oriented in a direction against the air jets of the other one of the blowpipes.

In accordance with still another feature of the present invention, the guide device includes cooling baffles. Further, at least one of the cooling baffles is swivelably mounted.

In accordance with still another feature of the present invention, the width of the zones is smaller than a width of a narrowest partial web roll to be processed. Further, the zones are between approximately 200 mm and 300 mm wide.

In accordance with a further feature of the present invention, zones in which edges of the partial web are located are partially activatable.

In accordance with a still further feature of the present invention, the device further includes a control device. The slitting station includes slitting devices that are movably positionable transversely to the run direction via the control device, and the control device is coupled to the guide device to selectively activate the plurality of zones in accordance with the positioning of the slitting devices.

The present invention is also directed to a guide device for guiding partial webs formed by a reel slitting device to a winding device that forms partial web rolls. The guide device includes a plurality of individually activatable zones laterally arranged across a machine width, and the plurality of individually activatable zones is oriented to direct an air jet toward the partial webs.

In accordance with another feature of the present invention, the device includes a switch point and a plurality of baffles, and the switch point and the plurality of baffles include the plurality of individually activatable zones.

In accordance with a further feature of the present invention, the switch point includes a first and a second blowpipe, and the plurality of individually activatable zones of the first and second blowpipe is oriented substantially toward each other. Further, the plurality of individually activatable zones of the first and second blowpipes is substantially complementarily activatable. Still further, the first and second blowpipes include zones that overlap edges of the partial webs, and the overlapping zones are not activated in both blowpipes.

In accordance with a still further feature of the present invention, the plurality of individually activatable zones of the plurality of baffles is substantially complementarily activatable.

In accordance with still another feature of the present invention, at least one of the plurality of baffles is swivelably mounted to adjust for increasing diameter of the partial web rolls.

In accordance with still another feature of the present invention, at least one of the plurality of baffles partially surrounds a winding tube adapted to receive the partial web.

In accordance with another feature of the present invention, the device includes a plurality of deflection rolls positioned between adjacent ones of the plurality of baffles.

In accordance with yet another feature of the present invention, the device includes blowpipes for diverting adjacent partial webs toward different sets of baffles.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention as described herein discusses winding a material web, e.g., a paper web, into finished rolls. However, it is noted that the present invention is not limited to paper webs, and that the features of the present invention may be utilized by the ordinarily skilled artisan with many other material webs and similar products.

A reel slitting device 1 includes a slitting station 2 to slit a material web 3 into a plurality of partial webs 4 and 5. The slit is formed in a longitudinal direction of the movement of the web so that partial webs 4 and 5 have widths less than the width of material web 3. Moreover, the sum of the widths of partial webs 4 and 5 correspond to the overall width of material web 3.

Figure 1:
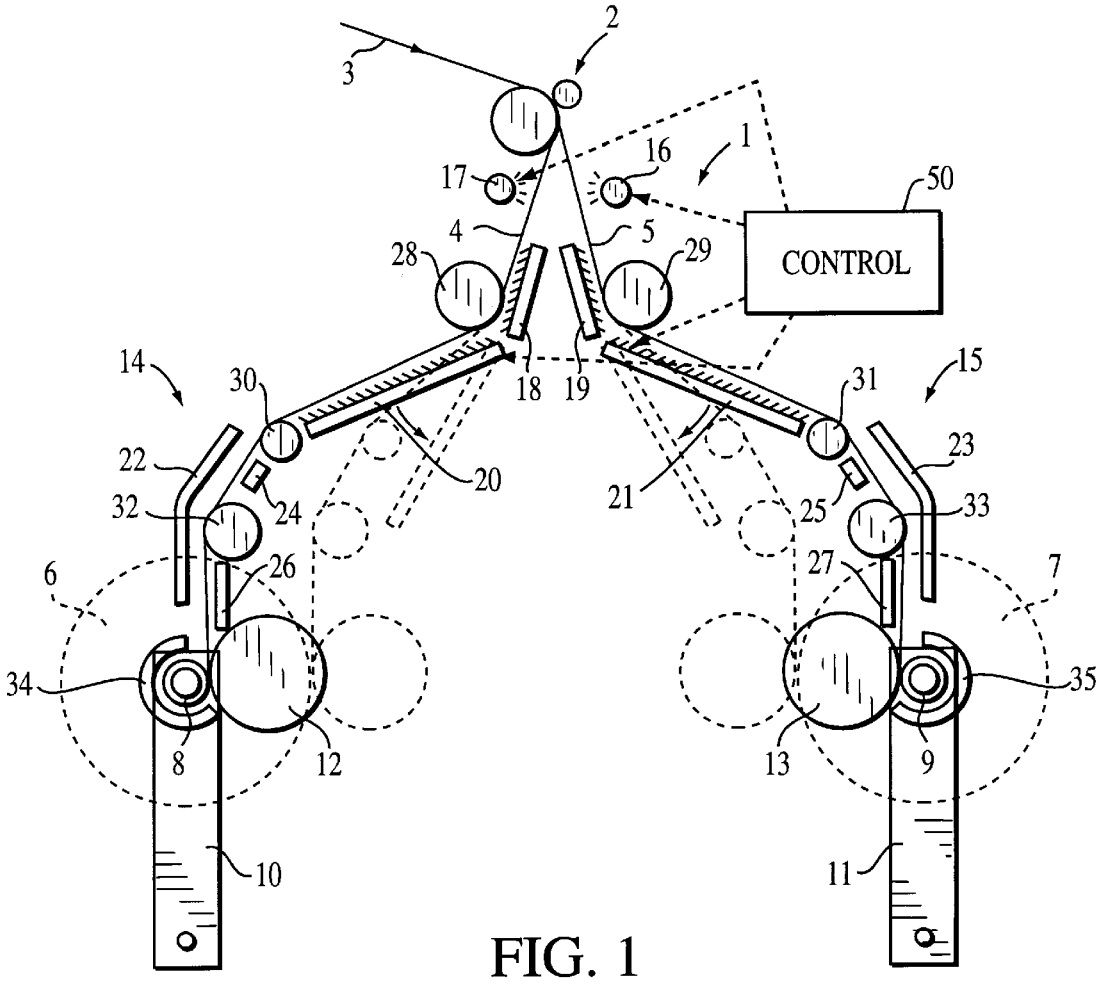
FIG. 1 illustrates a schematic side-view of a reel slitting device in accordance with the present invention.

The individual partial webs may be wound into partial web rolls 6 and 7, which are depicted in FIG. 1 in dashed lines. The condition at the beginning of the winding process is depicted with the solid lines in which partial webs 4 and 5 are fixed to roll cores (winding tubes) 8 and 9. Winding tubes 8 and 9 are mounted in bearing arms 10 and 11 for being driven, i.e., as a center winder. For a controlled construction of partial rolls 6 and 7, press rolls 12 and 13 are displaceably positioned to lie adjacent to a periphery of partial web rolls 6 and 7 such that as the diameter of partial web rolls 6 and 7 increases, press rolls 12 and 13 are radially displaced outwardly.

For winding, each winding tube 8 and 9, or each partial web roll 6 and 7, may be located in a winding position arranged in a plurality of winding position groups. The winding positions, and therefore the axes of the partial web rolls, in a same winding position group are substantially coaxially arranged, and the winding position groups 14 and 15 are arranged substantially parallel to each other. Moreover, individual partial web rolls in a same winding position group are located at a certain axial distance to each other. In this regard, in a gap region between adjacent partial web rolls in a same winding position group, a partial web roll is correspondingly positioned in another winding position group. Thus, when two winding position groups are utilized, the gap distance between adjacent partial web rolls in a same winding position group corresponds with a width of a partial web roll in the other winding position group.

Such an embodiment of the winding device is known to enable partial webs 4 and 5 to be fanned after passing through slitting station 2. That is, while adjacent partial webs 4 and 5 are guided to different winding position groups 14 and 15, they continue to run practically in the run direction without deflection in the transverse direction.

In order to be facilitate the fanning of the adjacent partial webs to distribute or guide partial webs 4 and 5 into different winding position groups 14 and 15, a guide device is utilized to guide partial webs 4 and 5 along different paths to their respective winding position groups. Both paths are formed to be substantially symmetric to each other.

The guide device includes a pair of blowpipes 16 and 17 that are positioned behind slitting station 2 in the web run direction. Blowpipes 16 and 17, in combination, form a pneumatically-functioning switch point, which will be discussed in further detail below. Along each provided path to the winding positions, cooling baffles 18, 20, 22, 24, 26 or 19, 21, 23, 25, 27 are arranged, and baffles 20 and 21 are swivelably mounted to change in orientation during the winding procedure to compensate for the changes in the partial web roll diameters. Moreover, deflection rolls 28, 30, 32 or 29, 31, 33 are utilized in conjunction with the baffles to guide the partial webs along their intended paths.

The guide device, i.e., blowpipes 16 and 17, cooling baffles 18–27, and deflection rolls 28–33, may be divided into relatively narrow zones that extend transversely across the total width of material web 3. Because the smallest partial web width that is to be processed has a width of approximately 400 mm, each zone may be formed with a width of, e.g., between approximately 200 mm and 300 mm.

Figure 2:
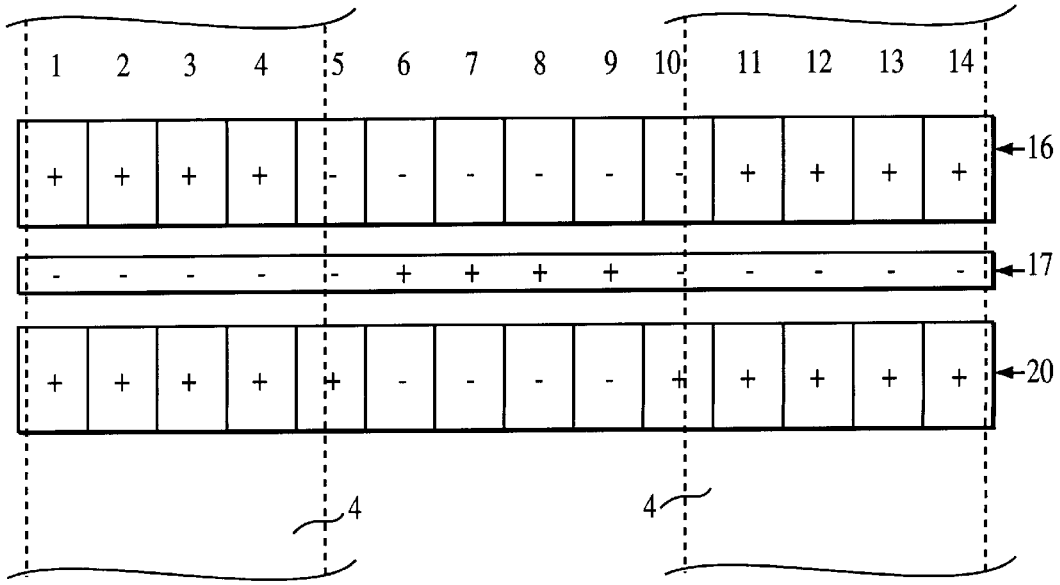
FIG. 2 illustrates a schematic depiction of the active/inactive/partially active states of the zones of the guide device.

Each of the blowpipes and the baffles may be coupled to an air supply, and the air flow from each zone of the blowpipes and baffles may be independently controlled. With reference to FIG. 2, the independent control of air flow from each zone is schematically depicted. FIG. 2 shows a schematic top-view of blowpipe 16 and cooling baffle 20, and depicts blowpipe 17 with a dashed line. Two partial webs 4 are illustrated in a dashed line, which represent guiding partial webs 4 along the path to winding position group 14. Each of the blowpipes and baffles are formed with a same number and same sized individual zones, e.g., fourteen zones numbered 1–14. As shown in FIG. 2, if blowpipe 16 or 17, or cooling baffle 20 expels air in a specified zone, a "+" is shown in the zone to represent an activated zone; if no air is expelled, a "–" is provided is represent a non-activated zone.

From the exemplary illustrations, it can be seen that the zones of blowpipe 16 that are provided to guide partial webs 4 to winding position group 14 initially blow partial webs 4 in a direction toward, and over, baffle 18. Conversely, complementary zones of blowpipe 17 guide partial webs 5 to winding position group 15 by initially blowing partial webs 5 in a direction toward, and over, baffle 19. In other words, once material web 3 has been slit into partial webs 4 and 5 by slitting station 2, the fanning or dividing of the partial webs toward different winding position groups 14 and 15 begins at the switch point formed by blowpipes 16 and 17 having air jets directed substantially against each other. For the exemplary illustration, zones 1–4 and 11–14 of blowpipe 16 are individually activated to expel air and blow partial webs 4 into the path leading to winding position group 14. Conversely, zones 6–9 of blowpipe 17 are individually activated to expel air and blow partial web 5 into the path leading to winding position group 15.

It is significant to note that the zones of blowpipes 16 and 17 are substantially complementarily activated, i.e., if a zone in blowpipe 16 is activated to expel air, the complementary zone in blowpipe 17 is not activated. However, in zones in which an edge of a partial web is located or the zones overlap the edge, e.g., as depicted in zones 5 and 10 of FIG. 2, neither zone is activated. Because the partial webs are adjacent to each other as they enter the switch point, deactivating the zones that overlap the edges of adjacent partial webs prevents the edges of a partial web from being blown in a direction opposite the middle of the partial web. For example, if zone 5 was also utilized in a purely complementary manner, and assuming that zone 5 in blowpipe 16 was activated to expel air, then the edges of the partial web 5 that also overlap into zone 5 would be blown toward winding position group 14 while the remainder of the partial web 5 would be blown toward winding position group 15. Because the zones overlapping the edges are deactivated, damage to the edges is avoided and ease of operation is ensured.

It is noted that, in contrast to blowpipes 16 and 17 discussed above, the zones arranged in cooling baffles 20–27 that overlap the edges may be activated to expel air. Thus as shown in FIG. 2, while only zones 1–4 and 11–14 are activated for blowpipe 16, zones 1–5 and 10–14 may be activated in cooling baffle 20 (as well as 18, 22, 24, and 26). Thus, the zones overlapping the edges may be characterized as partially activated.

This arrangement will not cause any damage because the adjacent partial web (partial web 5) has already been diverted along the path toward winding position group 15. Thus, the edges of the immediately adjacent partial web will not be adversely affected by the activation of the overlapped zone because adjacent partial web 5 is no longer present in the region of the cooling baffles of the path leading to winding position group 14. Moreover, if zones 5 and 10 are activated, then partial web 4 is supported over its entire face.

In the manner discussed above, the use of expelled air can be contained and controlled through the independent activation of individual zones of the cooling baffles. Further, the pressure of the air directed toward partial webs 4 and 5 can be increased, thereby improving the guiding of the partial webs to the winding areas for forming partial web rolls 6 and 7. Moreover, roll cores 8 and 9 may be partially surrounded by cooling baffles 34 and 35 to form partially closed spaces around the roll cores 8 and 9 with press rolls 12 and 13 positioned on an opposite side of the roll cores. In this manner, "threading" of partial webs 4 and 5 onto roll cores 8 and 9 may be facilitated.

Generally, it is only necessary that the entire guide device be active prior to the beginning the actual winding process, i.e., so that partial webs 4 and 5 may be appropriately guided onto winding cores 8 and 9. As soon as partial webs 4 and 5 are affixed to their respective roll cores 8 and 9, guiding of the partial webs 4 and 5 may be performed by deflection rolls 28–33 only. The air expelling components of the guide device may be deactivated during normal operation, or in a stand-by condition in the event of an occurrence of a web tear.

The width of the partial webs may be adjusted via a control device 50 to displace the knives in slitting station 2 and to correspondingly position bearing arms 10 and 11 of winding position groups 14 and 15. Control device 50 may also be utilized to simultaneously determine and actuate the active/inactive/partially active zones of the blowpipes and the cooling baffles of the guide device to properly guide the individual partial webs.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A reel slitting device for a material web comprising:

a slitting station that slits the material web into a plurality of partial webs;

a winding station that winds the plurality of partial webs into a plurality of partial web rolls;

the winding station including at least two winding position groups having winding units, the winding units within a same winding position group being located at a distance from each other to form axial gaps between adjacent partial web rolls;

a guide device that guides the partial webs between the slitting station and the winding position groups; and the guide device being divided into a plurality of zones that are arranged transversely to a run direction of the partial webs, wherein the plurality of zones is individually activatable.

2. The device in accordance with claim 1, the guide device, extending over a width of the material web, forming separate paths to each winding position group; and individual zones in one of the separate paths are substantially complementarily activated with respect to corresponding individual zones in the other of the separate paths that are not activated.

3. The device in accordance with claim 1, the guide device comprising a pneumatically-functioning switch point positioned downstream of the slitting station in the run direction.

4. The device in accordance with claim 3, the switch point comprising two blowpipes producing air jets, the air jets of one of the blowpipes being oriented in a direction against the air jets of the other one of the blowpipes.

5. The device in accordance with claim 1, the guide device including cooling baffles.

6. The device in accordance with claim 5, at least one of the cooling baffles being swivelably mounted.

7. The device in accordance with claim 1, the width of the zones being smaller than a width of a narrowest partial web roll to be processed.

8. The device in accordance with claim 7, the zones being between approximately 200 mm and 300 mm wide.

9. The device in accordance with claim 1, the zones in which edges of the partial web are located are partially activatable.

10. The device in accordance with claim 1, further comprising:

a control device;

the slitting station comprising slitting devices that are movably positionable transversely to the run direction via the control device; and the control device being coupled to the guide device to selectively activate the plurality of zones in accordance with the positioning of the slitting devices.

11. The device in accordance with claim 1, the slitting station comprising a plurality of slitting elements which are positionably adjustable transversely to the run direction.

12. The device in accordance with claim 1, wherein the plurality of zones expel air when activated.

13. A guide device for guiding partial webs formed by a reel slitting device to a winding device that forms partial web rolls comprising:

a plurality of individually activatable zones laterally arranged across a machine width;

the plurality of individually activatable zones being oriented to direct an air jet toward the partial webs; and a switch point and a plurality of baffles, the switch point and the plurality of baffles including the plurality of individually activatable zones.

14. The guide device in accordance with claim 13, the switch point comprising a first and a second blowpipe, the plurality of individually activatable zones of the first and second blowpipe being oriented substantially toward each other.

15. The guide device in accordance with claim 14, the plurality of individually activatable zones of the first and second blowpipes being substantially complementarily activatable.

16. The guide device in accordance with claim 15, the first and second blowpipes including zones that overlap edges of the partial webs; and the overlapping zones being not activated in both blowpipes.

17. The guide device in accordance with claim 13, the plurality of individually activatable zones of the plurality of baffles being substantially complementarily activatable.

18. The guide device in accordance with claim 13, at least one of the plurality of baffles being swivelably mounted to adjust for increasing diameter of the partial web rolls.

19. The guide device in accordance with claim 13, at least one of the plurality of baffles partially surrounding a winding tube adapted to receive the partial web.

20. A guide device for guiding partial webs formed by a reel slitting device to a winding device that forms partial web rolls comprising:

a plurality of individually activatable zones laterally arranged across a machine width;

the plurality of individually activatable zones being oriented to direct an air jet toward the partial webs; and a plurality of deflection rolls positioned between adjacent ones of the plurality of baffles.

21. A guide device for guiding partial webs formed by a reel slitting device to a winding device that forms partial web rolls comprising:

a plurality of individually activatable zones laterally arranged across a machine width;

the plurality of individually activatable zones being oriented to direct an air jet toward the partial webs; and blowpipes for diverting adjacent partial webs toward different sets of baffles.

* * * * *